US008607728B2

(12) United States Patent
Kouzoe

(10) Patent No.: US 8,607,728 B2
(45) Date of Patent: Dec. 17, 2013

(54) POWDER COATING APPARATUS

(75) Inventor: Katsutoshi Kouzoe, Tokyo (JP)

(73) Assignee: Nihon Parkerizing Co., Ltd., Chuo-Ku, Tokyo (JP)

( * ) Notice: Subject to any disclaimer, the term of this patent is extended or adjusted under 35 U.S.C. 154(b) by 105 days.

(21) Appl. No.: 13/223,903

(22) Filed: Sep. 1, 2011

(65) Prior Publication Data

US 2012/0055398 A1 Mar. 8, 2012

(30) Foreign Application Priority Data

Sep. 8, 2010 (JP) ..... 2010-201095

(51) Int. Cl.
*B05C 19/00* (2006.01)
*B05B 15/04* (2006.01)

(52) U.S. Cl.
USPC ..... 118/309; 118/308; 118/326; 454/50; 454/51

(58) Field of Classification Search
USPC ..... 118/308, 309, 634, DIG. 7, 326, 50; 454/50, 53, 55, 51, 52; 427/180; 55/DIG. 46
See application file for complete search history.

(56) References Cited

U.S. PATENT DOCUMENTS

| | | | | |
|---|---|---|---|---|
| 6,616,764 | B2 * | 9/2003 | Kramer et al. | 118/326 |
| 2004/0058141 | A1 * | 3/2004 | Shutic et al. | 428/314.8 |
| 2004/0074987 | A1 * | 4/2004 | Shutic | 239/225.1 |

* cited by examiner

*Primary Examiner* — Yewebdar Tadesse
(74) *Attorney, Agent, or Firm* — Price Heneveld LLP

(57) ABSTRACT

Air is continuously supplied into upper spaces via an air supply duct, during coating of an object to be coated in a paint booth, whereby the air is jetted through jetting holes and flows downwards along side walls. The air flowing downwards along the side walls is sucked into lower spaces, via clearances, and is discharged out of the paint booth via air exhaust ducts.

13 Claims, 4 Drawing Sheets

POWDER COATING APPARATUS

BACKGROUND OF THE INVENTION

1. Field of the Invention

The present invention relates to a powder coating apparatus, and more particularly, to a powder coating apparatus in which an object to be coated is coated through blowing of a powder coating material onto the object to be coated as the object to be coated passes through the interior of a paint booth.

2. Description of the Related Art

For instance, Japanese Patent Application Laid-open No. 2004-148805 discloses a conventional powder coating apparatus. In such a conventional powder coating apparatus, an electrostatic paint gun or the like provided inside a paint booth blows a powder coating material onto a suspended object to be coated, as the latter passes through the interior of the paint booth, to coat thereby the object to be coated. Not all the powder coating material blown onto the object to be coated in the paint booth becomes adhered to the object to be coated, and hence air in the paint booth is discharged, to discharge thereby, out of the paint booth, the powder coating material that fails to be applied and floats in the paint booth.

However, not all the powder coating material that does not adhere to the object to be coated can be discharged out of the paint booth through discharge of air from inside the paint booth, and some of the powder coating material becomes adhered to the walls or the like of the paint booth. Upon changes of color, therefore, the interior of the paint booth must be cleaned to prevent mixing with the color used before the change. Ordinarily, the coating operation is discontinued temporarily, and an operator cleans the interior of the paint booth using an air blower or the like. Color change takes therefore time. In order to shorten the color change time, Japanese Patent Application Laid-open No. 2006-239587 discloses a powder coating apparatus in which a side wall blowing section that jets air towards a side wall is provided so as to move from the top downwards with respect to the side wall, to enable thereby cleaning of the powder coating material adhered to the side wall, once coating is over.

However, the powder coating apparatus of Japanese Patent Application Laid-open No. 2006-239587 was problematic on account of the high cost and complex configuration required for enabling the up-and-down motion of the side wall blowing section that cleans the powder coating material adhered to the side wall.

SUMMARY OF THE INVENTION

In order to solve the above problems, it is an object of the present invention to provide a powder coating apparatus that prevents powder coating material from adhering to side walls using a simple configuration and at a low cost.

The present invention provides a powder coating apparatus, comprising: a paint booth having a ceiling, two side walls, two end walls and a floor; a first air jetting assembly coupled to upper portions of the two side walls, for causing air to flow downwards along the side walls; and an air discharge assembly coupled to lower portions of the two side walls, for sucking the air flowing along the side walls and discharging the air out of the paint booth.

These and other features, advantages and objects of the present invention will be further understood and appreciated by those skilled in the art by reference to the following specification, claims and appended drawings.

DESCRIPTION OF THE PREFERRED EMBODIMENT

Embodiments of the present invention are explained below with reference to the accompanying drawings.

Figure 1:
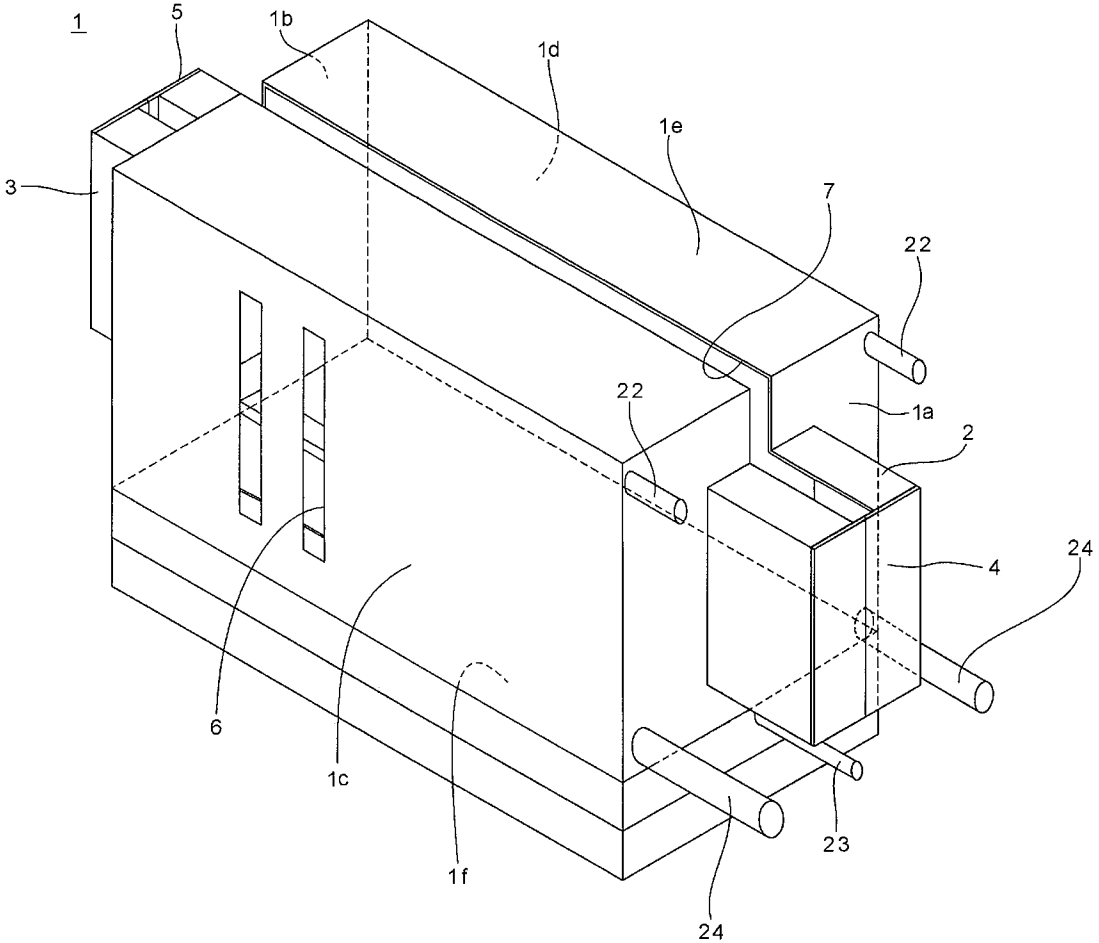
FIG. 1 is a perspective-view diagram of a paint booth of a powder coating apparatus according to an embodiment of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are exemplary embodiments of the inventive concepts defined in the appended claims. Hence, specific dimensions and other characteristics relating to the embodiments disclosed herein are not to be considered as limiting, unless the claims expressly state otherwise.

FIG. 1 is a perspective-view diagram of a paint booth of a powder coating apparatus according to an embodiment of the present invention. A paint booth 1 has overall a substantially parallelepiped shape, and comprises two mutually opposing end walls 1*a*, 1*b* in the longitudinal direction, two mutually opposing side walls 1*c*, 1*d* in a direction perpendicular to the longitudinal direction, a ceiling 1*e* and a floor 1*f*. The foregoing are made of a resin material. An inlet section 2 and an outlet section 3 are provided at both end walls 1*a*, 1*b*, respectively. The inlet section 2 and the outlet section 3 are closed and opened by doors 4 and 5, respectively. Painting openings 6 for providing a paint gun (not shown) that blows a powder coating into the paint booth 1 are respectively formed at the side walls 1*c*, 1*d*. Straight gaps 7 are respectively formed at the top faces of the ceiling 1*e*, the inlet section 2 and the outlet section 3 of the paint booth 1. The object to be coated (not shown) is conveyed into the paint booth while suspended on a suspending portion (not shown), in such a manner that the suspending portion can move along the gaps 7.

Figure 2:
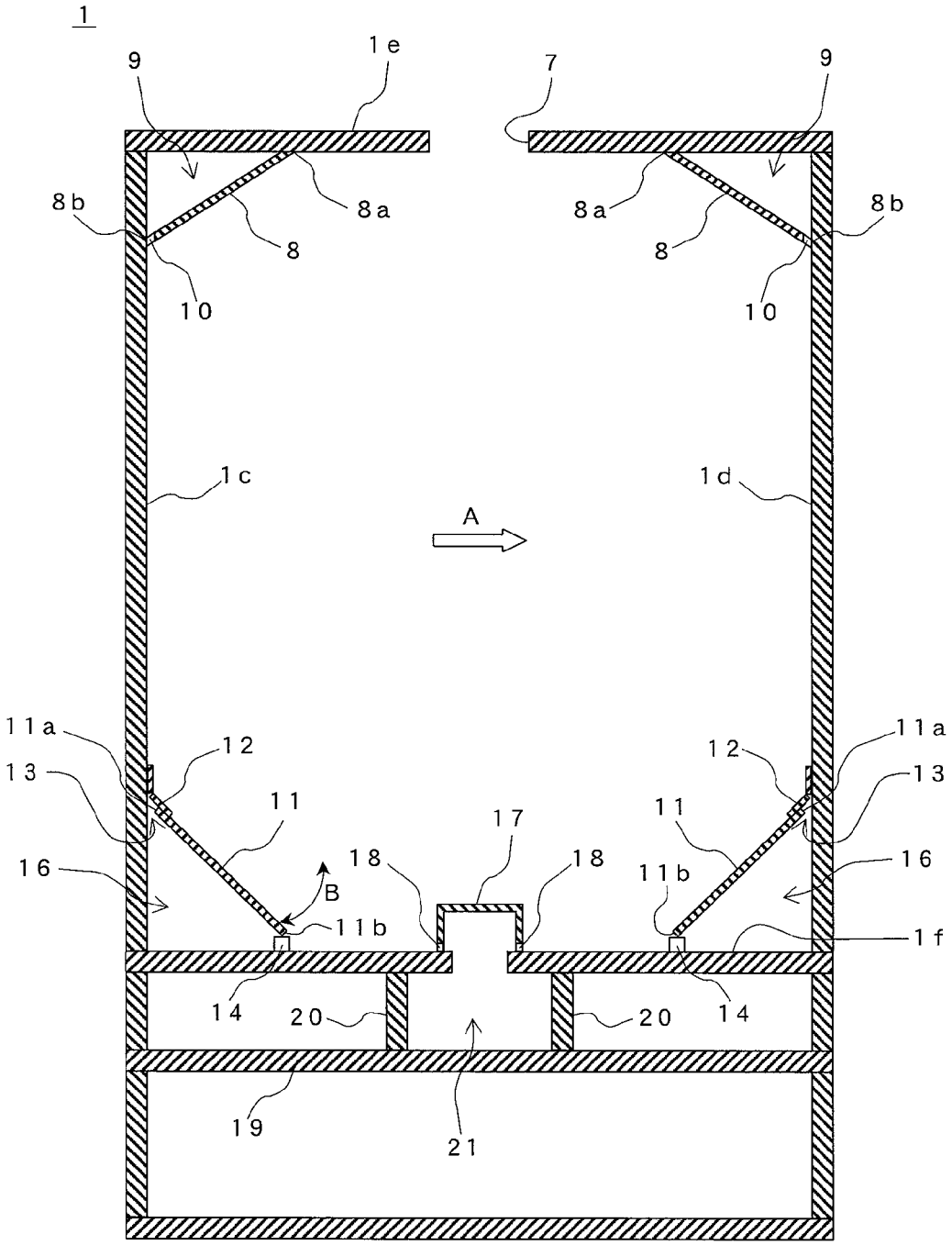
FIG. 2 is a cross-sectional diagram of the paint booth of a powder coating apparatus according to the embodiment of the present invention.

As illustrated in FIG. 2, resin-made rectangular plate-like members 8 (corresponding to a first plate-like member) are respectively provided at the top portion of the side walls 1*c*, 1*d* inside the paint booth 1. One long side portion 8*a* of each plate-like member 8 is fixed to the ceiling 1*e*, while the other long side portions 8*b* are fixed to the side walls 1*c*, 1*d*. The two short side portions 8*c*, 8*d* of each plate-like member 8 are fixed to the end walls 1*a*, 1*b*, respectively (see FIG. 3). Spaces 9 (corresponding to a first space) are formed by the plate-like members 8, the ceiling 1*e*, the side walls 1*c*, 1*d* and the end walls 1*a*, 1*b*. A plurality of jetting holes 10 (corresponding to a first jetting hole), created at appropriate intervals along the longitudinal direction of the paint booth 1, are provided at the portions at which the long side portions 8*b* are fixed to the side walls 1*c*, 1*d*. The size and shape of the jetting holes 10, the spacing between adjacent jetting holes 10 and so forth can be appropriately decided as a matter of design choice.

Figure 3:
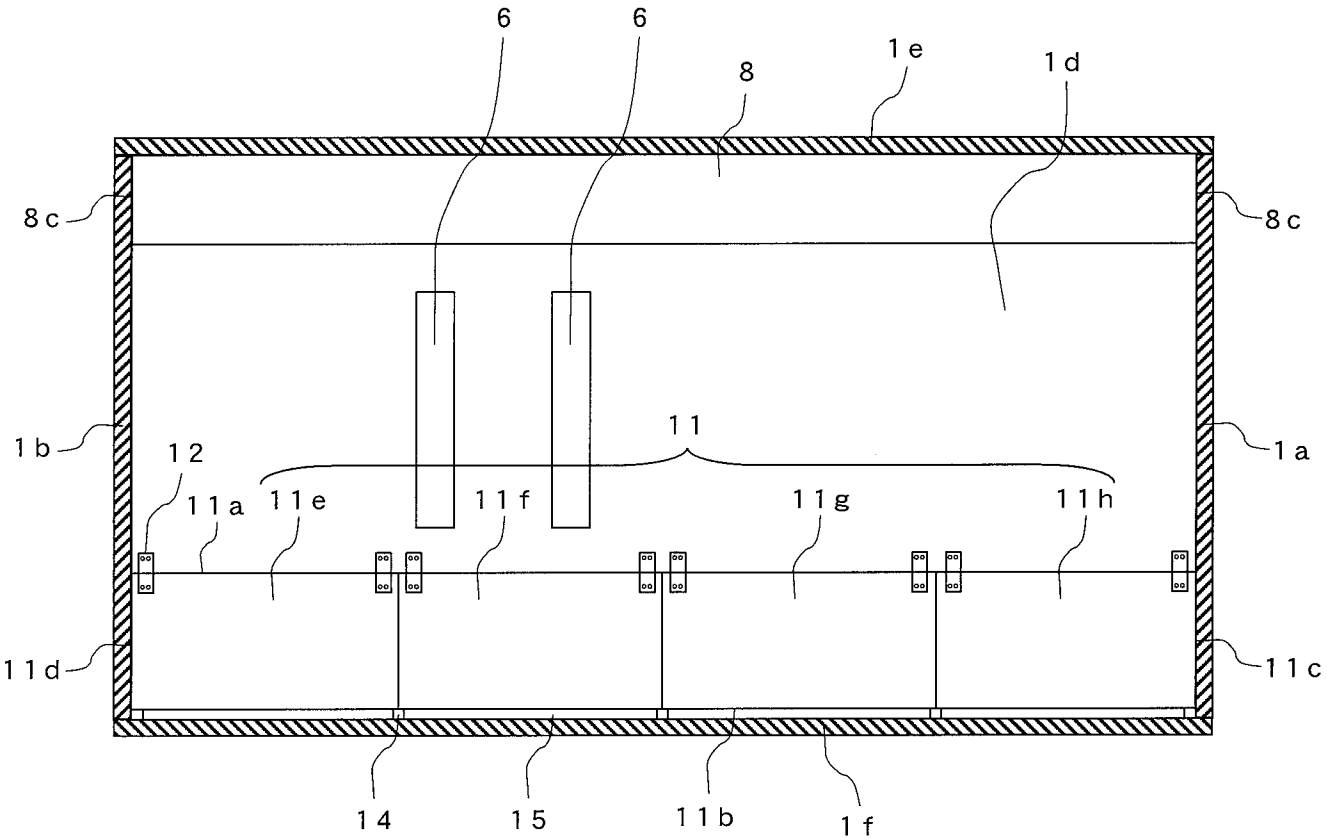
FIG. 3 is a cross-sectional front-view diagram viewed in the direction of arrow A in FIG. 2.

Resin-made rectangular plate-like members 11 (corresponding to a second plate-like member) are respectively provided at the lower portion of the side walls 1*c*, 1*d*, inside the paint booth 1. One of the long side portions 11*a* of each plate-like member 11 is connected to each of the side walls 1*c*, 1*d* by way of a respective hinge 12. The plate-like members 11 can swing in the direction of arrow B. A clearance 13 is formed between each long side portion 11*a* and the side walls 1*c*, 1*d*. The clearance 13 constitutes a first suction hole. A plurality of projections 14 is provided on the floor 1*f* in such a manner that the plurality of projections 14 abuts the long side portions 11*b* when the other long side portions 11*b* become positioned close to of the floor 1*f* upon swinging of the plate-like members 11. Clearances 15 (see FIG. 3) that constitute a second suction hole are formed, between the long side portions 11*b* and the floor 1*f*, through abutment of the long side portions 11*b* and the projections 14. The two short side portions 11*c*, 11*d* of each plate-like member 11 (see FIG. 3) are fixed to the end walls 1*a*, 1*b*, respectively (see FIG. 3). The plate-like members 11, the floor 1*f*, the side walls 1*c*, 1*d* and the end walls 1*a*, 1*b* form spaces 16 (corresponding to a second space). The plate-like members 11 may each be one single plate, but are preferably split into a plurality of split plate-like members 11*e* to 11*h* in the longitudinal direction, as illustrated in FIG. 3.

An air jetting portion 17 (corresponding to a second air jetting assembly) is provided, in the floor 1*f*, extending in the longitudinal direction of the paint booth 1 while protruding from the floor 1*f*, between the two plate-like members 11, as illustrated in FIG. 2. A plurality of jetting holes 18 (corresponding to a second jetting hole) created at appropriate spacings along the longitudinal direction is provided at the air jetting portion 17, at positions that oppose both plate-like members 11. The size and shape of the jetting holes 18, the spacing between adjacent jetting holes 18 and so forth can be appropriately decided as a matter of design choice. The jetting holes 18 need not be configured in the form of a plurality of holes, and may be one long and narrow slit that extends from one end to the other end of the air jetting portion 17.

A resin-made sub-floor plate 19 is provided below the floor 1*f*, parallel to the latter. Between the floor 1*f* and the sub-floor plate 19 there are provided two resin-made wall plates 20 appropriately spaced from and parallel to each other and perpendicular to the floor 1*f* and the sub-floor plate 19. The floor 1*f*, the sub-floor plate 19 and the two wall plates 20 form a space 21 (corresponding to a third space). That is, the space 21 is formed under the floor 1*f*, such that the space 21 and the air jetting portion 17 communicate with each other.

As illustrated in FIG. 1, two air supply ducts 22 (corresponding to a first air supply duct) are provided at the end wall 1*a* in such a manner that each air supply duct 22 communicates with a respective space 9 (see FIG. 2). An air supply duct 23 (corresponding to a second air supply duct) is provided at the end wall 1*a* in such a way so as to communicate with the space 21 (see FIG. 2). Each of the air supply ducts 22 and 23 is connected to a blower (not shown) in such a manner that air is supplied to the spaces 9 and the space 21. Two air exhaust ducts 24 are provided at the end wall 1*a* in such a way so as to communicate with respective spaces 16 (see FIG. 2). Air in the spaces 16 is discharged out by way of an exhaust fan (not shown) that is connected to the air exhaust ducts 24. The plate-like members 8 (see FIG. 2) and the air supply ducts 22 constitute a first air jetting assembly. The plate-like members 11 (see FIG. 2) and the air exhaust ducts 24 constitute an air discharge assembly.

Although not shown in FIGS. 1 to 3, there are also provided a duct, one end thereof being connected to the side wall 1*d* and the other end to an exhaust fan that is connected to the air exhaust ducts 24, as well as a cyclone and a bag filter provided along the duct. The exhaust fan causes powder coating material floating in the paint booth 1 to be discharged, together with air, out of the interior of the paint booth 1, via the duct, in such a manner that the powder coating material can be recovered by the cyclone. This configuration, which is a well-known one, may be modified into other known configurations such that air in the interior of the paint booth 1 is discharged out and the powder coating material in the air is separated and recovered.

The operation of the powder coating apparatus according to the present embodiment will be explained next with reference to FIGS. 1 to 3.

An object to be coated (not shown) is conveyed into the paint booth 1 via the inlet section 2. The doors 4, 5 remain open during the coating operation. The object to be coated that is conveyed into the paint booth 1 moves within the paint booth 1, during which time a powder coating material is blown onto the object to be coated by a paint gun (not shown), through the painting openings 6. The object to be coated becomes coated thereby. The powder coating material that fails to be coated onto the object to be coated and that floats in the paint booth 1 is discharged out of the paint booth 1 by way of a duct (not shown) that is connected to the side wall 1*d*.

However, some of the powder coating material that floats in the paint booth 1 may become adhered to the side walls 1*c*, 1*d* of the paint booth 1, and remain in the paint booth 1. Therefore, air is continuously supplied into the spaces 9 via the air supply ducts 22 by a blower (not shown) during coating of the object to be coated in the paint booth 1. The air supplied into the spaces 9 is jetted out of the jetting holes 10, and flows downwards along the side walls 1*c*, 1*d*. As a result, the powder coating material floating in the paint booth 1 becomes entrained by the air flow as the powder coating material gets near the side walls 1*c*, 1*d*. Adhesion of the powder coating material to the side walls 1*c*, 1*d* is prevented thereby.

Simultaneously with this operation, an exhaust fan (not shown) sucks air from inside the spaces 16 via the air exhaust ducts 24, and discharges the air out of the paint booth 1. Thereupon, the air flowing downwards along the side walls 1*c*, 1*d* is sucked into the spaces 16, via the clearances 13, and is discharged out of the paint booth 1 via the air exhaust ducts 24. That is, the powder coating material that is entrained by the air flowing downwards along the side wall 1*c*, 1*d* is discharged out of the paint booth 1 together with the air, and is thereby prevented from remaining in the paint booth 1.

In parallel to the above operations, a blower (not shown) supplies air into the space 21 via the air supply duct 23. The air supplied into the space 21 is jetted out of the jetting holes 18 of the air jetting portion 17. The air jetted out of the jetting holes 18 flows along the floor 1*f*, and entrains the powder coating material that falls on the floor 1*f*. The air jetted out of the jetting holes 18 is ultimately sucked into the spaces 16 via the clearances 15, and is discharged out of the paint booth 1 via the air exhaust ducts 24. That is, the powder coating material that is entrained by the air jetted out of the jetting holes 18 is discharged out of the paint booth 1 together with the air, and is thereby prevented from remaining in the paint booth 1.

The object to be coated, once coated in the paint booth 1, is conveyed out of the paint booth 1 via the outlet section 3. The above operation reduces the powder coating material that is retained in the paint booth 1, and making it possible to keep the affects of color mixing with a previous color to a minimum, even when colors are changed without cleaning the interior of the paint booth 1. The powder coating material discharged out of the paint booth 1 is recovered by a cyclone (not shown). This results in less waste of powder coating material, and hence makes for better coating efficiency.

Not all powder coating material, which has been sucked into the spaces 16 along with air, is discharged out of the paint booth 1 via the air exhaust ducts 24. Part of the powder coating material may in some cases become adhered to the end walls 1*a*, 1*b*, the side walls 1*c*, 1*d*, the floor 1*f* and the plate-like members 11 within the spaces 16. Since air is sucked into the spaces 16 via the clearances 13, 15, however, the powder coating material adhered in the spaces 16 does not flow out via the clearances 13, 15. The powder coating material adhered in the spaces 16 can be recovered by an operator or the like by swinging up the plate-like members 11, once the coating operation is over. In a case where the paint booth 1 is long in the longitudinal direction, opening and closing the plate-like members 11 may be a troublesome operation on account of the weight of the plate-like members 11, if the latter each comprise one single plate. However, dividing each plate-like member 11 into a plurality of split plate-like members 11*e* to 11*h* in the longitudinal direction of the paint booth 1 makes for an easier opening and closing of the plate-like members 11, in that just a respective split plate-like member need be opened and closed at a time. This allows the efficiency of the recovery operation of the powder coating material to be enhanced.

Thus, the first air jetting assembly coupled to the upper portions of the two side walls 1*c*, 1*d* cause air to flow downwards along the side walls 1*c*, 1*d*, and the air discharge assembly coupled to the lower portion of the two side walls 1*c*, 1*d* cause air flowing along the side walls 1*c*, 1*d* to be sucked and discharged out of the paint booth 1. As a result, powder coating material floating in the paint booth 1 does not become adhered to the side walls 1*c*, 1*d*, but is entrained by the air and discharged out of the paint booth 1. The powder coating material can thus be prevented from adhering to the side walls 1*c*, 1*d* by way of a simple configuration and at a low cost.

In the present embodiment, the air supply ducts 22, 23 and the air exhaust ducts 24 are all provided at the end wall 1*a*, but the embodiment is not limited to that configuration. For instance, the air supply ducts 22, 23 may be provided at the end wall 1*b* or the side walls 1*c*, 1*d*, and the air exhaust ducts 24 may be provided at the end wall 1*b*. That is, the air supply ducts 22, 23 may be provided so as to communicate with the spaces 9, 16, respectively. The air exhaust ducts 24 may be provided so as to communicate with the space 21.

In the present embodiment, the long side portions 8*b* of the plate-like members 8 are fixed to the side walls 1*c*, 1*d*, but the embodiment is not limited to that configuration. Instead, one narrow, long slit-like clearance may be formed between the long side portion 8*b* and the side walls 1*c*, 1*d*, without the foregoing two being fixed to each other. That is, the long side portions 8*b* may be disposed so as to be positioned closer to the side walls 1*c*, 1*d* than the long side portions 8*a*. In this case, the above-mentioned slit-like clearance constitutes a first jetting hole.

In the present embodiment, air is jetted continuously through the jetting holes 10 during coating of the object to be coated, but the embodiment is not limited to that configuration. For instance, air may be jetted intermittently, i.e. in the form of pulses, out of the jetting holes 10. In this case, the powder coating material becomes adhered to the side walls 1*c*, 1*d* at a time where no air is being jetted. However, the powder coating material adhered to the side walls 1*c*, 1*d* is removed through the pulse-like air jetting. The powder coating material can thereby be prevented from adhering to the side walls 1*c*, 1*d* by way of a simple configuration and at a low cost. The air jetting intervals, and the duration of each jetting are instances of design matter to be appropriately decided.

In the present embodiment, the end walls 1*a*, 1*b*, the side walls 1*c*, 1*d*, the ceiling 1*e*, the floor 1*f* and the plate-like members 8, 11 of the paint booth 1 are all made of a resin, but are not limited thereto, and may be made out of an arbitrary material. Preferably, however, there is selected a material that allows adhered powder coating material to be removed easily by air blowing. A person skilled in the art can easily select the material with the strength, cost and so forth of the material in mind.

Figure 4:
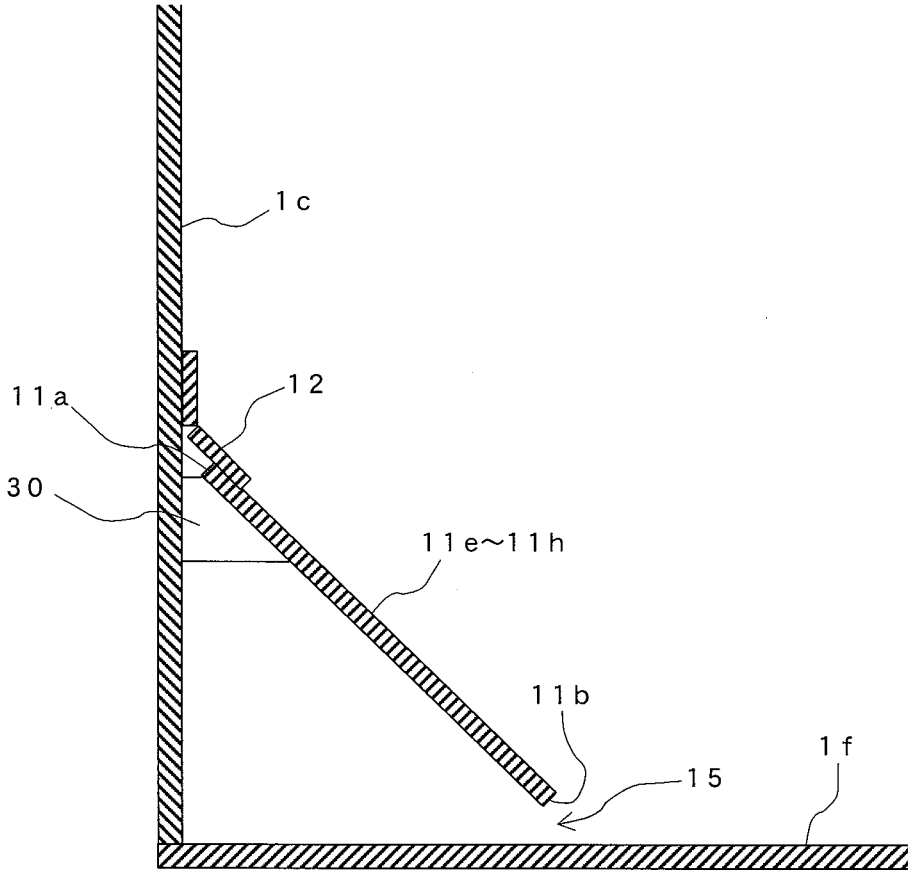
FIG. 4 is a cross-sectional diagram illustrating a variation of an air discharge assembly in the powder coating apparatus according to the embodiment.

In the present embodiment, the projections 14 are provided on the floor 1*f*, such that the clearances 15 are formed between the long side portions 11*b* and the floor 1*f* through abutting of the long side portions 11*b* of the plate-like members 11 against the projections 14. However, the embodiment is not limited to that configuration. For instance, the split plate-like members 11*e* to 11*h* connected to the side wall 1*c* by way of the hinges 12 may each be provided with at least one trapezoidal plate-like propping plate 30 in the vicinity of the long side portion 11*a*, on the side opposing the side wall 1*c*, as illustrated in FIG. 4. The propping plate 30 abuts the side wall 1*c* when a respective split plate-like member 11*e* to 11*h* is swung. The arc of the swing is restricted thereby. The clearances 15 between the long side portions 11*b* and the floor 1*f* can thus be formed as a result. Although not shown in the figures, the same applies to the split plate-like members 11*e* to 11*h* connected to the side wall 1*d* by way of the hinges 12. In such a configuration, the projections 14 (see FIG. 2) need not be provided on the floor 1*f*. This makes cleaning of the floor 1*f* easier. The shape of the propping plates 30 is not limited to a trapezoidal plate-like shape, and may be any arbitrary shape. The way in which the propping plates 30 are provided is not limited, so long as the clearances 15 can be formed between the long side portions 11*b* and the floor 1*f*.

In the present embodiment, the two short side portions 11*c*, 11*d* of the plate-like members 11 come into contact with the end walls 1*a*, 1*b*, respectively, but some clearance may be formed between the two short side portions 11*c*, 11*d* and the end walls 1*a*, 1*b*.

In the foregoing description, it will be readily appreciated by those skilled in the art that modifications may be made to the invention without departing from the concepts disclosed herein. Such modifications are to be considered as included in the following claims, unless these claims by their language expressly state otherwise.

What is claimed is:

1. A powder coating apparatus, comprising;

a paint booth having a ceiling, two side walls, two end walls and a floor;

a first air jetting assembly coupled to upper portions of the two side walls, for causing air to flow downwards along the side walls; and an air discharge assembly coupled to lower portions of the two side walls, for sucking the air flowing along the side walls and discharging the air out of the paint booth; and wherein the first air jetting assembly comprises:

a first plate member which is a rectangular member having two long side portions and two short side portions, such that one of the two long side portions is fixed to the ceiling while the two short side portions are respectively fixed to the two end walls, and the other one of the two long side portions is positioned closer to the side wall than the one of the long side portions, whereby a first space is formed by the first plate member, the ceiling, the side walls and the end walls; and a first air supply duct that supplies air from outside the paint booth into the first space, wherein a first jetting hole, through which the air supplied into the first space is jetted, is formed between the first plate member and each of the side walls.

2. The powder coating apparatus according to claim 1, wherein the first air jetting assembly provides jet air continuously during coating in the paint booth.

3. The powder coating apparatus according to claim 1, wherein the first air jetting assembly provides air in a pulsed manner during coating in the paint booth.

4. The powder coating apparatus according to claim 1, wherein the air discharge assembly comprises:

a second plate member which is a rectangular member having two long side portions and two short side portions, such that one of the two long side portions are connected to the side walls, whereby a second space is formed by the second plate member, the floor, the side walls and the end walls; and an air exhaust duct that discharges air from inside the second space out of the paint booth, and wherein a first suction hole that sucks the air into the second space is provided at a portion where the second plate member and the side walls are connected.

5. The powder coating apparatus according to claim 4, wherein the second plate member is rotatable about a portion connecting with the side walls.

6. The powder coating apparatus according to claim 5, wherein the second plate member is split into a plurality of split plate members, from one of the end walls to the other of the end walls.

7. The powder coating apparatus according to claim 4, wherein a second suction hole that sucks air into the second space is formed between the other one of the two long side portions of the second plate member and the floor.

8. The powder coating apparatus according to claim 7, further comprising:

a third space provided under the floor;

a second air supply duct that supplies air from outside the paint booth into the third space; and a second air jetting assembly protruding through the floor into the paint booth, for communicating with the third space, wherein the second air jetting assembly is provided with a second jetting hole that jets the air that has been supplied into the third space towards the second suction hole.

9. A powder coating apparatus, comprising:

a paint booth having a ceiling, two side walls, two end walls and a floor;

a first air jetting assembly coupled to upper portions of the two side walls, for causing air to flow downwards along the side walls; and an air discharge assembly coupled to lower portions of the two side walls, for sucking the air flowing along the side walls and discharging the air out of the paint booth; and wherein the air discharge assembly comprises:

a first plate member which is a rectangular member having two long side portions and two short side portions, such that one of the two long side portions are connected to the side walls, whereby a first space is formed by the first plate member, the floor, the side walls and the end walls; and an air exhaust duct that discharges air from inside the first space out of the paint booth, and wherein a first suction hole that sucks the air into the first space is provided at a portion where the first plate member and the side walls are connected.

10. The powder coating apparatus according to claim 9, wherein the first plate member is rotatable about a portion connecting with the side walls.

11. The powder coating apparatus according to claim 10, wherein the first plate member is split into a plurality of split plate members, from one of the end walls to the other of the end walls.

12. The powder coating apparatus according to claim 9, wherein a first suction hole that sucks air into the first space is formed between the other one of the two long side portions of the first plate member and the floor.

13. The powder coating apparatus according to claim 12, further comprising:

a second space provided under the floor;

a first air supply duct that supplies air from outside the paint booth into the second space; and a second air jetting assembly protruding through the floor into the paint booth, for communicating with the second space, wherein the second air jetting assembly is provided with a second jetting hole that jets the air that has been supplied into the second space towards the first suction hole.

* * * * *